US009938948B2

(12) United States Patent
Serra et al.

(10) Patent No.: US 9,938,948 B2
(45) Date of Patent: Apr. 10, 2018

(54) FLUID INJECTION ASSEMBLY FOR A COMBUSTION ENGINE

(71) Applicant: Continental Automotive GmbH, Hannover (DE)

(72) Inventors: Giandomenico Serra, San Giuliano Terme (IT); Daniel Marc, Leghorn (IT); Andrea Puccini, San Miniato (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 165 days.

(21) Appl. No.: 14/508,013

(22) Filed: Oct. 7, 2014

(65) Prior Publication Data

US 2015/0101572 A1 Apr. 16, 2015

(30) Foreign Application Priority Data

Oct. 10, 2013 (EP) ..... 13188110

(51) Int. Cl.
*F02M 61/14* (2006.01)

(52) U.S. Cl.
CPC ..... *F02M 61/145* (2013.01); *F02M 61/14* (2013.01); *F02M 2200/8023* (2013.01); *F02M 2200/853* (2013.01); *F02M 2200/856* (2013.01)

(58) Field of Classification Search
CPC ..... F02M 2200/852; F02M 2200/853; F02M 2200/8015; F02M 2200/8023; F02M 2200/856; F02M 61/14
USPC ..... 123/470
See application file for complete search history.

(56) References Cited

U.S. PATENT DOCUMENTS

| | | | | |
|---|---|---|---|---|
| 5,724,946 | A | 3/1998 | Franchitto | 123/470 |
| 5,803,052 | A | 9/1998 | Lorraine et al. | 123/470 |
| 5,970,953 | A | 10/1999 | Lorraine et al. | 123/470 |
| 6,276,339 | B1 | 8/2001 | Shebert, Jr. et al. | 123/470 |
| 6,832,187 | B1 | 12/2004 | Dow et al. | 703/27 |
| 7,063,075 | B2 | 6/2006 | Berger et al. | 123/470 |
| 7,802,559 | B2 | 9/2010 | Fürst et al. | 123/470 |

(Continued)

FOREIGN PATENT DOCUMENTS

| | | | | |
|---|---|---|---|---|
| DE | 102005020380 A1 | 11/2006 | | F02M 61/14 |
| EP | 1998038 A1 * | 12/2008 | | F02M 61/14 |
| EP | 1892408 B1 | 10/2009 | | F02M 55/00 |

(Continued)

OTHER PUBLICATIONS

European Search Report, Application No. 13188110.4, 5 pages, dated Feb. 18, 2014.

*Primary Examiner* — Jacob Amick
*Assistant Examiner* — Michael A Kessler
(74) *Attorney, Agent, or Firm* — Slayden Grubert Beard PLLC

(57) ABSTRACT

A fluid injection assembly for a combustion engine includes an injector body having a notch, an injector cup, which radially encloses an axial end of the injector body and has a projecting part, and a spring clip arranged between the injector body and the injector cup. The spring clip includes a ground plate, at least one spring element, and at least one holding element engaging behind the projecting part of the injector cup. The ground plate is arranged in the notch of the injector body. The injector body and the injector cup are coupled together by the spring clip by mechanical interaction via the projecting part and the notch, respectively.

17 Claims, 4 Drawing Sheets

(56) References Cited

U.S. PATENT DOCUMENTS

| | | | | |
|---|---|---|---|---|
| 7,861,692 | B2 | 1/2011 | Biasci et al. | 123/470 |
| 2013/0192565 | A1* | 8/2013 | Roseborsky | F02M 61/14<br>123/470 |

FOREIGN PATENT DOCUMENTS

| | | | | |
|---|---|---|---|---|
| EP | 2221469 | A1 | 8/2010 | F02M 55/02 |
| EP | 2058509 | B1 | 7/2012 | F02M 55/00 |
| EP | 2492486 | A1 | 8/2012 | F02B 25/22 |
| EP | 2492489 | A1 | 8/2012 | F02M 55/00 |
| JP | 2010168965 | A | 8/2010 | F02M 55/02 |
| WO | 2011/144411 | A1 | 11/2011 | F02M 55/00 |

* cited by examiner

FLUID INJECTION ASSEMBLY FOR A COMBUSTION ENGINE

CROSS-REFERENCE TO RELATED APPLICATIONS

This application claims priority to EP Patent Application No. 13188110 filed Oct. 10, 2013. The contents of which are incorporated herein by reference in their entirety.

TECHNICAL FIELD

The invention relates to fluid injection assembly for a combustion engine.

BACKGROUND

Fluid injectors are in wide spread use, in particular for internal combustion engines where they may be arranged in order to dose fluid into an intake manifold of an internal combustion engine or directly into a combustion chamber of a cylinder of the internal combustion engine.

To obtain a good engine performance the orientation of such a high pressure fuel injector in reference to the combustion chamber must be guaranteed.

SUMMARY

One embodiment provides a fluid injection assembly for a combustion engine having a central longitudinal axis and comprising: an injector body having a notch, an injector cup, which radially encloses an axial end of the injector body and has a projecting part, a spring clip which is arranged between the injector body and the injector cup and comprises a ground plate, at least one spring element coupled with the ground plate, and at least one holding element extending in the direction of the longitudinal axis and engaging behind the projecting part of the injector cup, wherein the ground plate is arranged in the notch of the injector body and the spring element abuts the projecting part of the injector cup such that a spring force is exerted by the spring clip biasing the injector body and the injector cup away from one another, and wherein the injector body and the injector cup are coupled together by the spring clip by means of mechanical interaction via the projecting part and the notch, respectively.

In a further embodiment, the holding element and the injector cup comprise two common contact areas axially spaced apart from each other to avoid an inclination between the injector cup and the holding element.

In a further embodiment, the spring clip comprises a recess extending laterally inwards from one end of the ground plate for receiving the injector body.

In a further embodiment, the spring clip is snap-fixed with the injector body, in particular by means of the recess.

In a further embodiment, the injector body comprises a step and the spring clip mechanically interacts with the step to prevent a rotary movement between the injector body and the spring clip.

In a further embodiment, the at least one spring element is a spring arm formed integrally with the ground plate, preferably by bending.

In a further embodiment, the holding element extends longitudinally through a groove of the projecting part.

In a further embodiment, the holding element is arranged at the spring element.

In a further embodiment, the holding element is arranged at the ground plate.

In a further embodiment, the injector cup comprises a stop element and the holding element engages behind the stop element to prevent a movement of the spring clip in a radial direction, in particular out of the groove.

In a further embodiment, one contact area of the two contact areas is arranged at the stop element.

In a further embodiment, the holding element comprises a projecting part and one contact area of the two contact areas is arranged at the projecting part.

BRIEF DESCRIPTION OF THE DRAWINGS

Example embodiments of the invention are explained below with reference to the drawings, in which.

DETAILED DESCRIPTION

Figure 1:
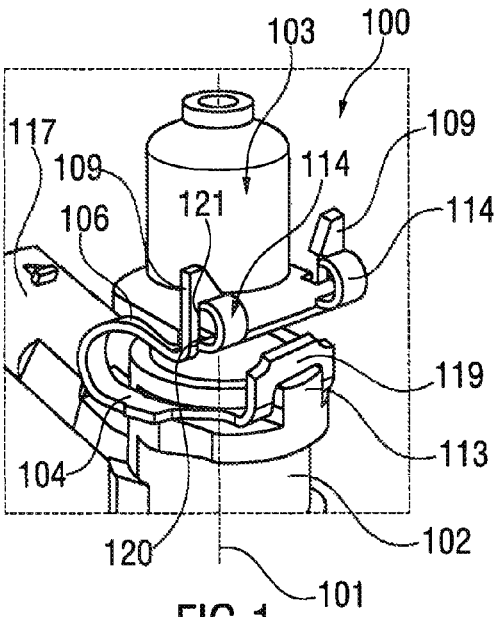
FIG. 1 shows a perspective view of a fluid injection assembly according to a first exemplary embodiment.

Embodiments of the present disclosure to provide an fluid injection assembly for a combustion engine with a restricted movement between an injector body and an injector cup.

A fluid injection assembly for a combustion engine is specified.

It has a central longitudinal axis and comprises an injector body and an injector cup.

The injector body has a notch. The injector body is in particular comprised by a fluid injector such as a fuel injector.

The injector cup radially encloses an axial end of the injector body and has a projecting part. The projecting part is preferably a collar around an opening of the injector cup. The injector body may expediently extend into the injector cup through the opening.

The fluid injection assembly further comprises a spring clip that is arranged between the injector body and the injector cup. The spring clip comprises a ground plate which in particular has a normal parallel to the longitudinal axis. The spring clip comprises at least one spring element coupled with the ground plate. For example the spring element is in one piece with the ground plate. The spring clip further comprises at least one holding element that extends in the direction of the longitudinal axis and engages behind a projecting part of the injector cup. That the holding element extends in the direction of the longitudinal axis means in particular that it is elongated in the longitudinal direction, i.e. the longitudinal dimension is the largest dimension of the holding element.

The ground plate is arranged in the notch of the injector body and the spring element abuts the project in part of the injector cup such that a spring force is exerted by the spring clip biasing the injector body and the injector cup away from one another. The injector body and the injector cup are coupled together by the spring clip by means of mechanical interaction via the projecting part and the notch, respectively, with the spring clip.

Due to the holding element that extends from the spring clip to the injector cup, a rotary movement between the injector cup and the spring clip is prevented. The holding element realizes an easy adjustment of the spring clip and the injector cup with respect to each other. The injector cup can be produced cost-effectively, for example the injector cup is simply deep drawn.

In particular, the holding element engages behind the projecting part in such fashion that axial displacement of the injector cup away from the spring clip is limited in axial direction away from the injector body. Further, the ground plate is in particular arranged in the notch in such fashion that axial displacement of the injector body away from the spring clip is limited in axial direction away from the injector cup.

In this way, the maximum relative axial displacement of the injector cup and the injector body away from one another is limited by means of the spring clip. The maximum relative axial displacement of the injector cup and the injector body away from one another may preferably selected such that the spring clip remains preloaded when the fluid injection assembly is not installed in the engine, e.g. during transportation. In this way, the risk of unintended disassembly of the fluid injection assembly, e.g. during transportation, is particularly small. In addition, the fluid injection assembly can be installed in the engine particularly easy.

In one embodiment, the holding element and the injector cup comprise two common contact areas which are axially spaced apart from each other to avoid an inclination between the injector cup and the holding element. By avoiding an inclination between the injector cup and the holding element a tilting of the injector body with respect to the injector cup is avoided. Furthermore, due to the arrangement of the spring clip in the notch of the injector body an inclination between the injector body and the injector cup is avoided, e.g. during transportation. In addition, the fluid injection assembly may have a small radial overall dimension due to the axial mounting.

According to further embodiments the spring clip comprises a recess extending laterally inwards from one end of the ground plate. The recess is in particular provided for receiving the injector body. In other words, the injector body in particular extends through the recess in longitudinal direction.

In one embodiment, the spring clip can be snap-fixed with the injector body by means of the recess. When the ground plate of the spring clip is snap-fixed in the notch of the injector body a protrusion in radial direction between the ground plate of the spring clip and the axial end of the injector body limits a movement of the spring clip in the direction toward the axial end. The protrusion may represent an upper wall of the notch. The axial movement in the opposite axial direction is also restricted by the notch, in particular by a lower wall of the notch. Because the holding element of the spring clip engages behind the projecting part of the injector cup, also an axial movement of the injector cup is restricted in the direction out of engagement with the axial end of the injector body.

According to further embodiments the injector body comprises a step. The step is arranged and configured to prevent a rotary movement between the injector body and the spring clip by means of mechanical interaction with the spring clip, for example with a bottom of the recess in the ground plate. With the step a rotary movement between the spring clip and the injector body can be prevented. Thus, also a rotary movement between the injector cup and the injector body can be prevented.

According to further embodiments, the at least one spring element is a spring arm formed integrally with the ground plate, e.g. by bending. Hereby the spring element can be easily created.

According to further embodiments the holding element extends longitudinally through a groove of the projecting part. Thus, the fluid injection assembly needs less space. In addition, a good coupling between the spring clip and the injector cup for blocking rotational movement between the spring clip and the injector cup is achievable in this way.

According to further embodiments the holding element is arranged at the spring element. For example, the holding element is positioned adjacent to a first end of the spring element which is opposite of a second end of the spring element, the second end being positioned adjacent to or adjoining the ground plate. For example, the holding element is formed integrally with the spring element, e.g. by bending. The injector cup can be mounted to the injector body after the spring clip is arranged on the injector body. In one embodiment, the injector cup is snap-fixed with the spring clip by means of the holding element.

According to further embodiments the injector cup comprises a stop element and the holding element engages behind the stop element to prevent a movement of the spring clip in a direction transverse to the longitudinal axis, i.e. a lateral direction. The stop element may contribute to prevent a tilting of the injector body with respect to the longitudinal axis. Thus, a precise positioning of the injector body is achievable.

According to further embodiments the holding element is arranged at the ground plate. For example, it projects from the ground plate in longitudinal direction towards the injector cup and in particular in the region of the bottom of the recess of the ground plate. The spring clip can be mounted to the injector body after the injector cup is arranged on the injector body.

According to further embodiments the spring element has a contact area with the injector cup and the contact area is arranged at a side of the projecting part of the injector cup. Thus, an axial force can be applied from the injector cup to the spring clip and from the spring clip to the injector body.

FIGS. 1 to 5 show a fluid injection assembly 100 and the some of the elements of the fluid injection assembly 100 according to a first exemplary embodiment.

FIG. 1 shows a portion of the fluid injection assembly 100 in a perspective view. The fluid injection assembly 100 is particularly suitable for dosing fuel to an internal combustion engine. The fluid injection assembly 100 has a central longitudinal axis 101.

The fluid injection assembly 100 comprises an injector body 102 that is comprised by a fuel injector for injecting fuel into an intake manifold or into a combustion chamber of an internal combustion engine. The injector body 102 comprises an injector sleeve 116 surrounded by a molded plastic housing (cf. FIG. 5). The injector sleeve 116 extends in longitudinal direction 101 for hydraulically coupling a fluid inlet end to a fluid outlet end.

The fluid injection assembly 100 further comprises an injector cup 103 that radially encloses an axial end of the injector body 102. In particular, the fluid inlet end of the injector sleeve 116 is received in the injector cup 103. The fluid injection assembly 100 is operable to supply fuel from a fuel rail (not shown in the figures) to the fluid inlet end of the injector sleeve 116 through the injector cup 102.

The fluid injection assembly 100 further comprises a spring clip 104 that is arranged between the injector cup 103 and the injector body 102. The spring clip 104 comprises a ground plate 105 that is in contact with the injector body 102. The spring clip 104 further comprises two spring elements 106 that are in contact with the injector cup 103. The spring clip 104 exerts a spring force in the direction of the longitudinal axis 101 such that the injector body 102 and the injector cup 103 are pushed away from each other.

The injector body 102 comprises a connector 117 for connecting the injector to an electrical power supply and/or an electric control unit such as an engine control unit. The injector body 102, in particular the plastic housing further comprises a notch 108. The notch is arranged at the side surfaces of the injector body 102. In particular, it extends radially inwards from an outer circumferential surface of the plastic housing. The notch 108 operable to couple the spring clip 104 with the injector body 102. Particularly the ground plate 105 is arranged in the notch 108. In particular, the injector body 102 and the spring clip 104 are configured for establishing a form-fit connection between the ground plate 105 of the spring clip 104 and an upper wall and/or a lower wall of the notch 108 to limit axial displacement of the spring clip 104 with respect to the injector body 102 in direction towards the injector cup 103 and away from the injector cup 103, respectively. Preferably, the ground plate 105 abuts the lower wall of the notch 108 for biasing the injector body 102 in longitudinal direction away from the injector cup 103. The injector body 102, in particular its plastic housing, further comprises a step 113. The step 113 is arranged for preventing a rotary movement of the spring clip 104 with respect to the injector body 102.

Figure 2:
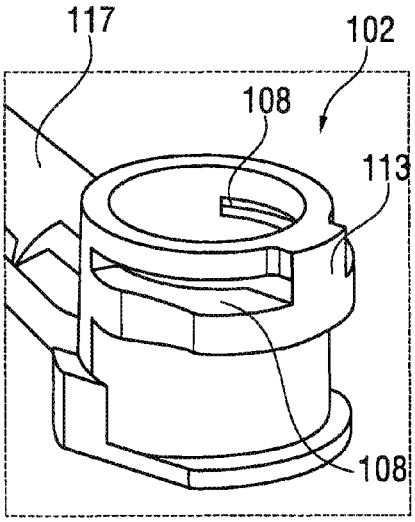
FIG. 2 shows a perspective view of a housing of the injector body of the fluid injection assembly according to the first embodiment.

The perspective view of FIG. 2 shows the plastic housing of the injector body 102 in more detail. The notch 108 is shaped to allow the ground plate 105 of the spring clip 104 to be shifted into the notch 108 in a lateral direction. The radial dimension of the injector body 102 between the notch 108 and the injector cup 103 is larger than the radius of a recess 112 (cf. FIG. 3) of the spring clip 104. The radial dimension of the injector body 102 between the notch 108 and the fluid outlet end is also larger than the axial radius of the recess 112 in a region adjacent to the ground plate 105. Thus, a movement of the spring clip 104 along the central longitudinal axis 101 with respect to the injector body 102 is prevented.

Figure 3:
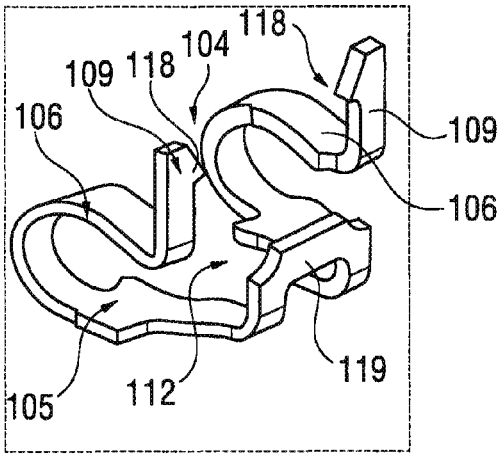
FIG. 3 shows a perspective view of a spring clip of the fluid injection assembly according to the first embodiment.

The perspective view of FIG. 3 shows the spring clip 104 in more detail. The ground plate 105 comprises the recess 112 that is open in one direction transverse to the central longitudinal axis 101. Thus, the spring clip 104 can be mounted on the injector body 102 by simply snap-fixing the spring clip 104 on the injector body 102—in particular on the metallic injector sleeve 116—laterally. The spring elements 106 each are spring arms that are formed integrally with the ground plate 105 by bending. For example, the spring clip 104 is made of metal.

The spring clip 104 comprises a heightening 119. The heightening 119 for example projects longitudinally beyond the ground plate 105. The heightening 119 acts together with the step 113 of the injector body 102 to define the relative orientation of the spring clip 104 with respect to the injector body 102. Further a rotary movement of the injector body 102 with respect to the spring clip 104 is blocked when the step 113 is arranged in the heightening 119. Further, the heightening 119 may be configured for enabling elastic lateral deformation of the ground plate 105 so that the transverse dimensions of the recess 112 can change to provide the flexibility required for the snap-fit connection with the injector sleeve 116.

Two holding elements 109 are arranged at the spring arms 106. For example, each holding element 109 is formed integrally with the spring element 106 by bending. In the present embodiment, the holding elements 109 extend first ends of the spring arms which are opposite of respective second ends of the spring arms at which second ends the spring arms merge with the ground plate 105. The holding element 109 extends along the central longitudinal axis 101. Each holding element 109 comprises a projecting part 118. The two projecting parts 118 face toward one another. The projecting parts 118 are designed to engage a projecting part 111 of the injector cup 103. For coupling the injector cup 103 with the spring clip 104 the two holding elements 109 are bent away from the each other. When the projecting part 111 of the injector body 102 is arranged between the projecting parts 118 and the ground plate 104, the holding elements 109 spring back to their original position and thus limit a movement of the injector cup 103 along the central longitudinal axis 101 with respect to the spring clip 104 in a direction away from the injector body 102. This is in particular effected by a form-fit engagement between the projecting parts 118 of the holding elements 109 and the projecting part 111 of the injector cup 103. Further, the holding elements 109 are arranged to prevent a rotational movement of the injector cup 103 with respect to the spring clip 104.

The projecting parts 118 and the projecting part 111 of the injector cup 103 can have a clearance from each other during operation to allow the relative movement in direction of the longitudinal axis 101. In this way, the spring clip 104 may be preloaded for clamping the injector body to an engine head of the internal combustion engine, for example.

Figure 4:
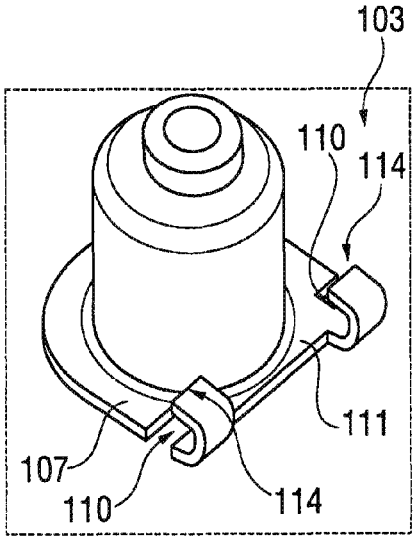
FIG. 4 shows perspective view of an injector cup of the fluid injection assembly according to the first embodiment.

The perspective view of FIG. 4 shows the injector cup 103 in more detail. The injector cup 103 comprises the projecting part 111 at an end that faces the injector body 102 when the fluid injection assembly 100 is assembled. The projecting part 111 is a collar which extends circumferentially around an opening through which the injector sleeve 116 is inserted into the injector cup 103. The projecting part has two grooves 110 which extend laterally inward into the projecting part 111 and extend completely through the projecting part 111 in longitudinal direction. The position of the grooves 110 defines the relative orientation of the spring clip with respect to the injector cup 103. The holding elements 109 are arranged in the grooves 110—i.e. extend through the grooves 110 in longitudinal direction—when the injector cup 103 is coupled with the spring clip 104. Furthermore, rotation of the spring clip 104 with respect to the injector cup 103 is prevented.

The injector cup 103 comprises two stop elements 114 adjacent to the grooves 110. For example, the stop elements 114 each are made by bending a part of the projecting part 111 twice. The stop elements 114 can prevent a tilting of the injector cup 103 with respect to the spring clip 104 and the injector body 102. Furthermore, the stop element 114 may be operable to limit a movement of the spring clip 104 in a radial outward direction with respect to the injector cup 103.

Figure 5:
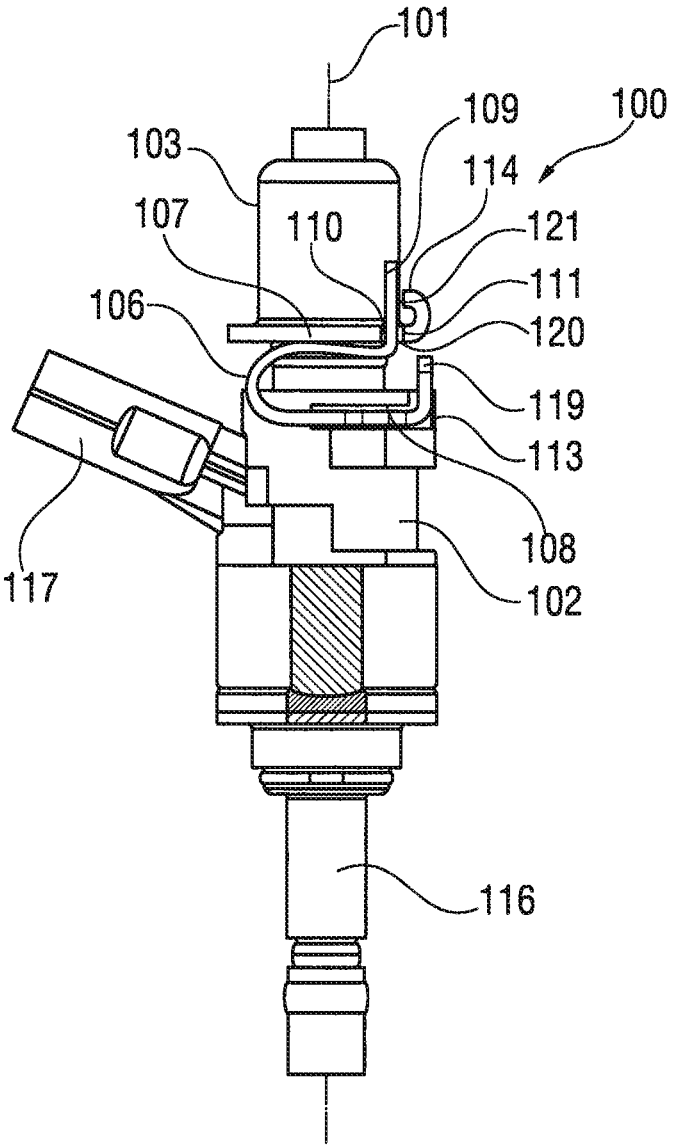
FIG. 5 shows a side view of the fluid injection assembly according to the first embodiment.
Figure 6:
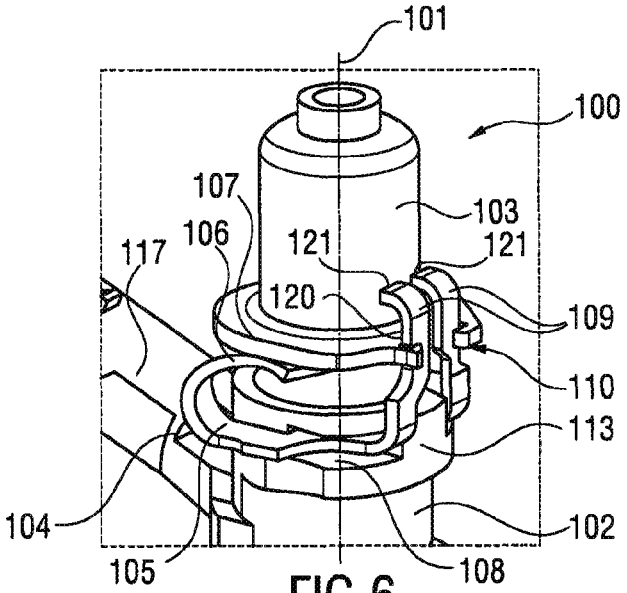
FIG. 6 shows a fluid injection assembly according to a second exemplary embodiment in a perspective view.

FIG. 5 shows a side view of the fluid injection assembly 100 with the injector body 102 and the injector cup 103 coupled together by the holding elements 109.

The plastic housing of the injector body 102 is fixed with the injector sleeve 116. The spring clip 104 is arranged in the notch 108 of the plastic housing of the injector body 102. The step 113 of the injector body 102 is in engagement with the heightening 119 of the spring clip 104. Due to the notch 108 and the step 113, the orientation between the injector body 102 and the spring clip 104 is defined and a movement of the spring clip 104 with respect to the injector body 102 is largely prevented. The holding elements 109 of the spring clip 104 extend behind the projecting part 111 of the injector cup 103. The holding elements 109 are each arranged in the respective groove 110 and are in contact with the stop element 114. The spring element 106 comprises a common contact area 107 with the projecting part 111 of the injector cup 103.

The injector cup 103 and the injector body 102 are connected through the spring clip 104. For mounting, first the spring clip 104 is inserted onto the injector body 102. The ground plate 105 snaps over the injector sleeve 116, for example over an injector inlet tube which makes part of the injector sleeve 116. Therefore, a loss of the spring clip 104 is prevented. The indexing and/or anti-rotating function between the two components is guaranteed by the step 113 of the injector body 102.

Next, the injector body 102 with the spring clip 104 snap-fixed to the injector sleeve 116 is inserted into the injector cup 103. The injector cup 103 is coupled with the fuel rail at a side opposite of its projecting part 111. The two holding elements 109 that comprise the shape of a fork snap into the dedicated grooves 110 of the injector cup 103. The movement of the injector body 102 away from the injector cup 103 in the central longitudinal axis 101 is limited by the projecting parts 118 of the holding elements 109 interacting with the projecting part 111 of the injector cup 103. A free end of the stop element 114 is in contact with the holding element 109. The stop element 114 is designed such that a respective contact area 121 between the holding elements 109 and the injector cup 103 is arranged at the stop element 114. In particular, the contact area 121 is established by mating longitudinal surfaces of the projecting parts 118 of the holding elements 109 and of the stop elements. A "longitudinal" surface is a surface which extends parallel to the longitudinal axis 101 in this context. A further contact area 120 between each holding element 109 and the injector cup 103 is arranged at the respective groove 110. The contact areas 120 and 121 are arranged axially at a distance from each other. By the two contact areas 120 and 121 being disposed axially at a distance from each other the tilting of the holding elements 109 with respect to the longitudinal axis of the injector cup 103 is largely avoided.

In addition, the ground plate 105 of the spring clip 104 cooperates with the notch 108 to largely avoid tilting between the spring clip 104 and the injector body 102. Thus, the inclination of the injector body 102 with respect to the injector cup 103 is avoided. In this way the rotational movements of any component with respect to the fuel rail and therefore with respect to the combustion chamber is avoided.

FIGS. 6 to 9 schematically shows a fluid injection assembly 100 according to a second embodiment. The fluid injection assembly 100 basically corresponds to the fluid injection assembly 100 according to the first exemplary embodiment as described with respect to FIGS. 1 to 5. The injector body 102 comprises the same shape as shown in FIG. 2, for example and described above in connection with the first embodiment.

Figure 7:
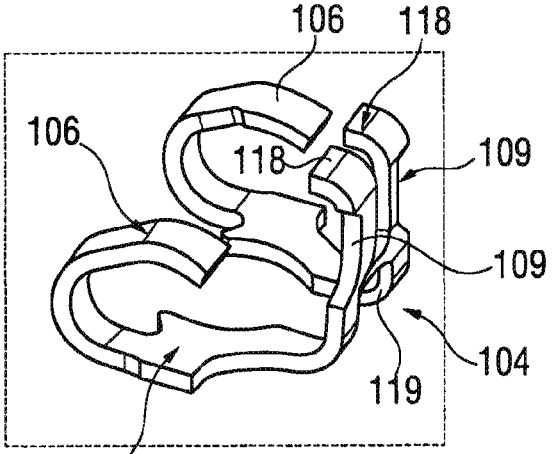
FIG. 7 shows a perspective view of a spring clip of the fluid injection assembly according to the second embodiment.

FIG. 7 shows the spring clip 104 of the fluid injection assembly 100 according to the second embodiment. In contrast to the first embodiment described with respect to FIGS. 1 to 5, the holding elements 109 are arranged directly at the ground plate 105 of the spring clip 104, separate from the spring elements 106. Instead, the holding elements 109 are combined with the heightening 119 in the present embodiment. The projecting part 111 of the injector cup 103 comprises one single groove 110 for the holding elements 109.

The two holding elements 109 are arranged at the heightening 119. The two projecting parts 118 of the holding elements 109 are facing laterally inwards toward the injector cup 103. The two holding elements 109 are flexible such that they can be bent laterally towards one another.

Figure 8:
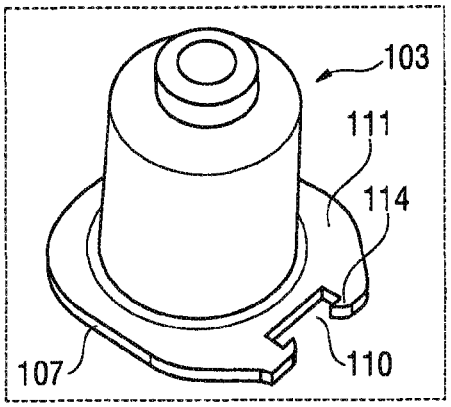
FIG. 8 shows perspective view of an injector cup of the fluid injection assembly according to the second embodiment.

FIG. 8 schematically shows the injector cup 103. The groove 110 comprises a generally T-shaped form in top view along the longitudinal axis 101 such that a movement of the spring clip 104 with respect to the injector cup 103 in radial outward direction is blocked when the holding elements 109 are arranged in the groove 110. The radially outward positioned constriction of the groove 110 which is responsible for the T-shape is shaped by two stop elements 114, for example, which may be formed integrally with the projecting part 111 of the injector cup 103.

Figure 9:
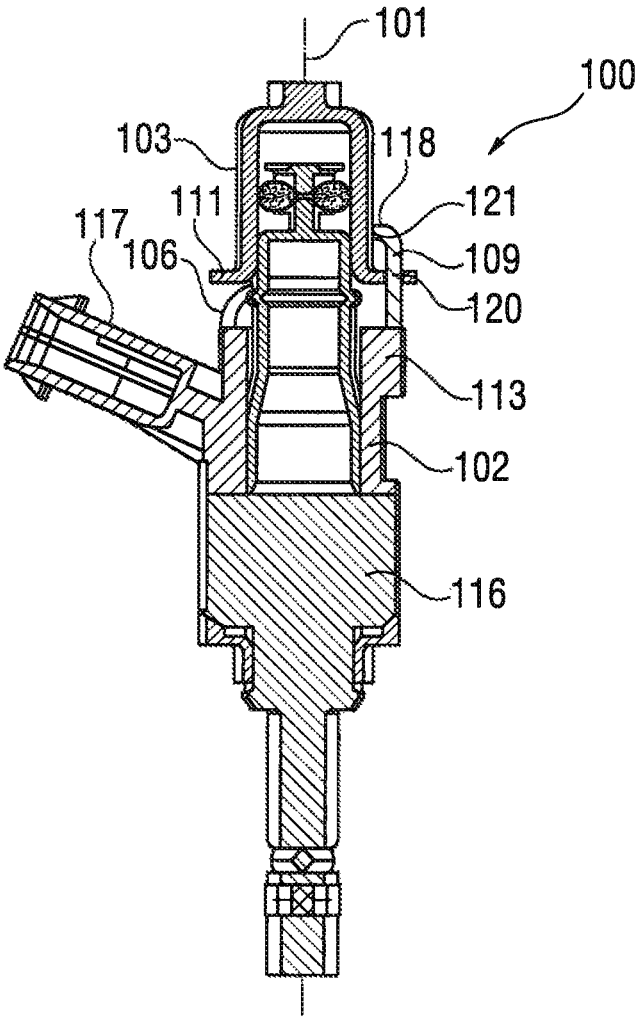
FIG. 9 shows a longitudinal sectional view of the fluid injection assembly according to the second embodiment.

FIG. 9 schematically shows a longitudinal sectional view of the fluid injection assembly 100 according to the second exemplary embodiment. The injector cup 103 and the injector body 102 are connected through the spring clip 104.

For mounting, the injector body 102 with the injector sleeve 116 is axially inserted into the injector cup 103 before assembly with the spring clip 104. The injector cup is arranged at the fuel rail. When the injector body 102 and the injector cup 103 are in position, the spring clip 104 is laterally inserted. The ground plate 105 of the spring clip 104 is inserted into the notch 108 of the injector body 102. The spring clip 104 snaps over the injector sleeve 116 via the recess 112. At the same time, the holding elements 109 of the spring clip 104 are inserted inside the groove 110 on the projecting part 111 of the injector 103 and snap in laterally behind the stop elements 114 of the projecting part 111. For example, each of the stop elements 114 is provided with a laterally outward directed chamfer to ease the lateral bending of the holding elements 109 towards one another for the insertion of the holding elements 109 into the groove 110. The two holding elements 109 move towards each other during insertion and return their initial position inside the groove 110. The holding elements 109 prevent the spring clip 104 from detaching and secure the connection between the injector body 102 and the injector cup 103. The end of the holding elements 109 that faces away from the injector body 102 comprises the projecting parts 118. The projecting parts 118 are arranged for limiting the movement of the spring clip 104 along the central longitudinal axis 101 with respect to the injector cup 103 by means of being operable to come into form-fit engagement with the projecting part 111 of the injector cup 103. Furthermore, relative axial displacement of the spring clip 104 and the injector body 102 is limited as described above for the first embodiment. Thus, a disassembly of the fluid injection assembly 100 can be avoided.

The projecting parts 118 further prevent an inclination of the injector body 102 with respect to the injector cup 103. For example, a lateral distance between the projecting parts 118 and the injector cup 103 is minimized. A free end of the projecting part 118 is in contact with the injector cup 103. The projecting parts 118 each are designed such that a respective contact area 121 between the holding elements 109 and the injector cup 103 is arranged at the respective projecting parts 118. A further contact area 120 between each holding element 109 and the injector cup 103 is arranged at the groove 110. The contact areas 120 and 121 are arranged axially at a distance from each other so that they are operable to block tilting between the spring element 104 and the injector cup 103. By the two contact areas 120 and 121 being disposed axially at a distance from each other the tilting of the holding elements 109 with respect to the longitudinal axis of the injector cup 103 is avoided. Furthermore, tilting of the spring clip 104 and the injector body 102 is limited as described above for the first embodiment by interaction between the ground plate 105 and the notch 108. Thus, the inclination of the injector body 102 with respect to the injector cup 103 is avoided. The spring elements 106 provide the axial force applied to the injector body 102 after their assembly to the engine.

The fluid injection assembly 100 comprises a defined orientation between the injector body 102, the spring clip 104 and the injector cup 103. Therefore a correct position of the fluid injection assembly 100 inside the combustion chamber is easily achievable. Furthermore, the orientation of the fluid injection assembly 100 with respect to the combustion chamber is guaranteed to reach a given engine performance. Thus, the fuel spray targeting inside the combustion chamber is accurately controllable. Thus, negative impacts on the engine emissions and performances can be avoided. The spring clip 104 allows an axial force to the injector body 102 for a clamping function. The spring clip 104 defines the orientation of the injector body 102 and the injector sleeve 116 with respect to the combustion chamber due to the given orientation of the spring clip 104 with respect to the injector cup 103. Furthermore, the injector cup 103, the spring clip 104 and the injector body 102 are held together and coupled to the rail during transportation and assembly operation. Thus, the loss of components can be avoided. The injector cup 103 comprises the groove 110 or a multitude of grooves 110 that act together with the holding elements 109. Thus, the injector cup 103 satisfies the tasks of indexing the fluid injection assembly 100, of fixing it to the fuel rail and of avoiding inclination and dismounting of the fluid injection assembly 100 during transport. The position of the holding elements 109 at the spring elements 106 or at the ground plate 105 results in a better functioning with the stops for inclination in less space. The lateral position of the holding elements 109 can limit the packaging. For example, the injector cup is deep drawn and no other component is braced to the injector cup 103.

What is claimed is:

1. A fluid injection assembly for a combustion engine having a central longitudinal axis and comprising:

an injector body having a notch, an injector cup that radially encloses an axial end of the injector body and has a projecting part, and a spring clip arranged between the injector body and the injector cup, the spring clip comprising a ground plate, a spring element, and two holding elements extending in the direction of the longitudinal axis and engaging behind the projecting part of the injector cup, wherein the spring element extends from a first end of the ground plate and the holding element extends from a second end of the ground plate opposite the first end, wherein the ground plate is arranged in the notch of the injector body and the spring element presses against the projecting part of the injector cup such that a spring force is exerted by the spring clip biasing the injector body and the injector cup away from one another, wherein the holding element couples the injector body and the injector cup together by engagement with the projecting part of the injector cup, wherein the holding element and the injector cup comprise two common contact areas axially spaced apart from each other to avoid an inclination between the injector cup and the holding element, with a first of the two common contact areas located at the projecting part of the injector cup and a second of the two common contact areas remote from the projecting part of the injector cup.

2. The fluid injection assembly of claim 1, wherein the holding element and the injector cup comprise two common contact areas axially spaced apart from each other to avoid an inclination between the injector cup and the holding element, with a first of the two common contact areas located at the projecting part of the injector cup and a second of the two common contact areas remote from the projecting part of the injector cup.

3. The fluid injection assembly of claim 1, wherein the spring clip comprises a recess extending laterally inwards from one end of the ground plate for receiving the injector body.

4. The fluid injection assembly of claim 1, wherein the spring clip is snap-fit to the injector body.

5. The fluid injection assembly of claim 1, wherein the injector body comprises a step, and the spring clip mechanically interacts with the step to prevent a rotary movement between the injector body and the spring clip.

6. The fluid injection assembly of claim 1, wherein the at least one spring element is a spring arm formed integrally with the ground plate.

7. The fluid injection assembly of claim 1, wherein the holding element extends longitudinally through a groove of the projecting part.

8. The fluid injection assembly of claim 1, wherein the injector cup comprises a stop element, and the holding element engages behind the stop element to prevent a movement of the spring clip in a radial direction.

9. The fluid injection assembly of claim 8, wherein the holding element and the injector cup comprise two common contact areas axially spaced apart from each other to avoid an inclination between the injector cup and the holding element, and wherein one contact area of the two contact areas is arranged at the stop element.

10. A combustion engine comprising a fluid injection assembly comprising:

an injector body having a notch, an injector cup that radially encloses an axial end of the injector body and has a projecting part, and a spring clip arranged between the injector body and the injector cup, the spring clip comprising a ground plate, a spring element, and a holding element extending in the direction of a longitudinal axis of the combustion engine and engaging behind the projecting part of the injector cup, wherein the spring element extends from a first end of the ground plate and the holding element extends from a second end of the ground plate opposite the first end, wherein the ground plate is arranged in the notch of the injector body and the spring element presses against the projecting part of the injector cup such that a spring force is exerted by the spring clip biasing the injector body and the injector cup away from one another, wherein the holding element couples the injector body and the injector cup together by engagement with the projecting part of the injector cup, wherein the holding element and the injector cup comprise two common contact areas axially spaced apart from each other to avoid an inclination between the injector cup and the holding element, with a first of the two common contact areas located at the projecting part of the injector cup and a second of the two common contact areas remote from the projecting part of the injector cup.

11. The combustion engine of claim 10, wherein the holding element and the injector cup comprise two common contact areas axially spaced apart from each other to avoid an inclination between the injector cup and the holding element, with a first of the two common contact areas located at the projecting part of the injector cup and a second of the two common contact areas remote from the projecting part of the injector cup.

12. The combustion engine of claim 10, wherein the spring clip comprises a recess extending laterally inwards from one end of the ground plate for receiving the injector body.

13. The combustion engine of claim 10, wherein the spring clip is snap-fixed with the injector body.

14. The combustion engine of claim 10, wherein the injector body comprises a step, and the spring clip mechanically interacts with the step to prevent a rotary movement between the injector body and the spring clip.

15. The combustion engine of claim 10, wherein the at least one spring element is a spring arm formed integrally with the ground plate.

16. The combustion engine of claim 10, wherein the holding element extends longitudinally through a groove of the projecting part.

17. A fluid injection assembly for a combustion engine having a central longitudinal axis and comprising:

an injector body having a notch, an injector cup that radially encloses an axial end of the injector body and has a projecting part, a spring clip arranged between the injector body and the injector cup, the spring clip comprising a ground plate, at least one spring element coupled with the ground plate, and two holding elements extending parallel to the central longitudinal axis and engaging behind the projecting part of the injector cup, wherein the ground plate is arranged in the notch of the injector body and the spring element abuts the projecting part of the injector cup such that a spring force is exerted by the spring clip biasing the injector body and the injector cup away from one another, wherein the injector body and the injector cup are coupled together by the spring clip by a mechanical interaction via the projecting part and the notch, respectively, wherein the projecting part is a collar which extends around a circumferential sidewall of the injector cup, wherein the collar comprises a groove and the two holding elements are flexible for insertion into the groove, wherein the two holding elements and the injector cup comprise two common contact areas, wherein each of the two common contact areas is in a respective plane perpendicular to the central longitudinal axis and the two respective planes are axially spaced apart from each other along the central longitudinal axis, to avoid an inclination between the injector cup and the holding element, wherein one of the contact areas is arranged at the groove, and wherein a free end of the holding element which is bent in a radially inward direction to contact the circumferential side wall for forming the other one of the contact areas.

* * * * *